US006227678B1

(12) United States Patent
Yau

(10) Patent No.: US 6,227,678 B1
(45) Date of Patent: May 8, 2001

(54) LIGHTING DEVICE

(76) Inventor: Andrew Kai Ching Yau, 22nd Floor, 498-500 Nathan Road, Kowloon (HK)

( * ) Notice: Subject to any disclaimer, the term of this patent is extended or adjusted under 35 U.S.C. 154(b) by 0 days.

(21) Appl. No.: 09/372,112

(22) Filed: Aug. 11, 1999

(51) Int. Cl.[7] ..... F21L 4/04

(52) U.S. Cl. ..... 362/205; 362/202; 362/204; 362/304; 362/306

(58) Field of Search ..... 362/205, 202, 362/204, 304, 306

(56) References Cited

U.S. PATENT DOCUMENTS 5,457,609 * 10/1995 Bhanot et al. ..... 361/814

5,678,921 * 10/1997 Kish et al. ..... 362/205

* cited by examiner

*Primary Examiner*—Sandra O'Shea
*Assistant Examiner*—Ali Alavi
(74) *Attorney, Agent, or Firm*—Leydig, Voit & Mayer, Ltd.

(57) ABSTRACT

A lighting device includes a body having a compartment for containing a battery cell, a light bulb supported by the body for energization by the battery cell, a switch on the body for controlling the energization of the light bulb, and at least one contact unit at one end of the compartment for making co-axial contact withthe battery cell. The contact unit includes a conductive coil spring having an end, a conductive end cap at the end for contacting the battery cell, and a stationaryholder for maintaining the spring substantially straight.

6 Claims, 3 Drawing Sheets

LIGHTING DEVICE

The present invention relates to a lighting device which incorporates a reliable contact for a battery cell contained therein.

SUMMARY OF THE INVENTION

According to the invention, there is provided a lighting device comprising comprising a body having a compartment for containing a battery cell, a light source supported by the body for energization by the battery cell, a switch provided on the body for controlling the energization of the light source, and at least one contact unit provided at one end of the compartment for making contact with the battery cell co-axially, said contact unit comprising a co-axial conductive coil spring having an end, a conductive end piece provided at the spring end for contacting the battery cell, and a stationary holder for maintaining the spring substantially straight.

Preferably, the end piece is in the form of an end cap covering the spring end.

In a preferred embodiment, the holder is arranged also to retain the end piece on the spring end.

More preferably, the holder has a hole through which the end piece extends, and the end piece is in the form of an end cap covering the spring end and having a peripheral flange engaged behind the hole for retaining by the holder.

It is preferred that the spring is a helical coil spring.

Advantageously, the compartment has two opposite ends, at each of which a said contact unit is provided.

More advantageously, the light source is provided at one end of the compartment for connection to the battery cell by means of the respective contact unit, said contact unit including a similar end piece provided at the opposite end of the associated spring for contact with the light source.

The lighting device preferably includes a conductive strip which is provided between the light source and the switch and is positioned by means of a bracket covering a free end of the strip.

More preferably, the other end of the strip is connected to the switch and its intermediate portion is exposed for connection to the light source.

The aforesaid lighting device may be in the form of a flashlight.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
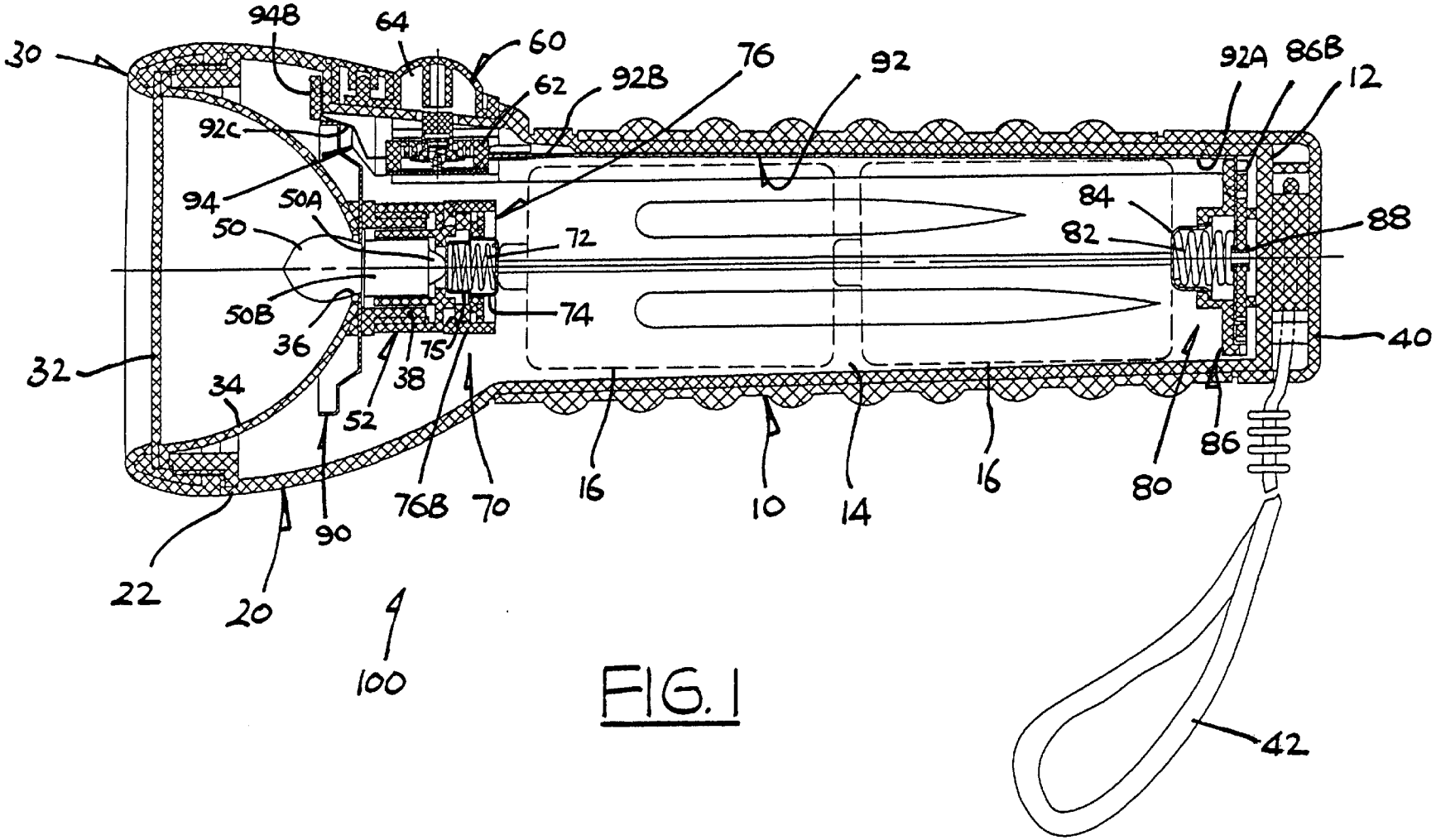
FIG. 1 is a cross-sectional side view of an embodiment of a lighting device in accordance with the invention, the device incorporating a pair of contact units for battery cells.
Figure 2:
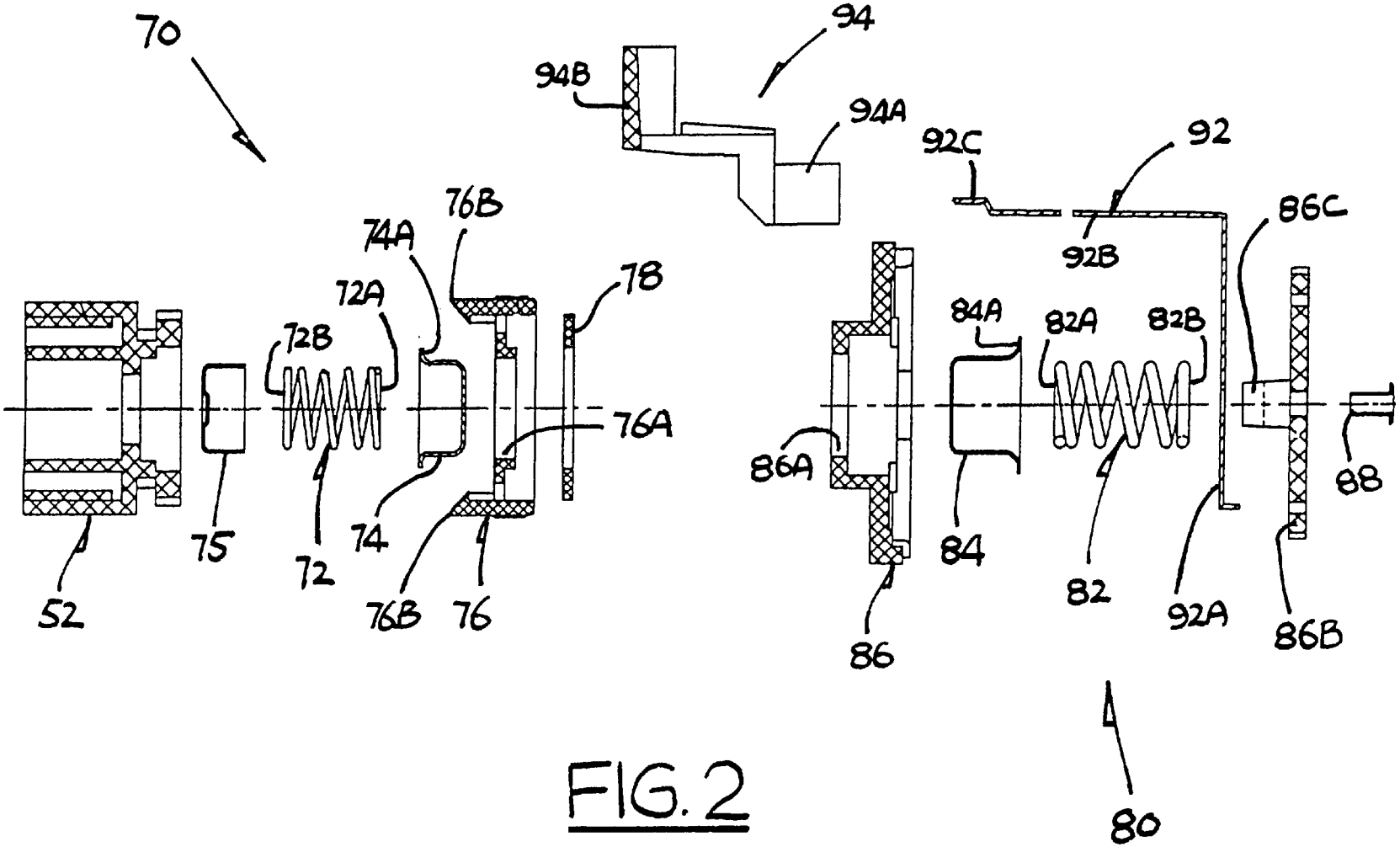
FIG. 2 is an exploded cross-sectional side view of the contact units of FIG. 1.
Figure 3:
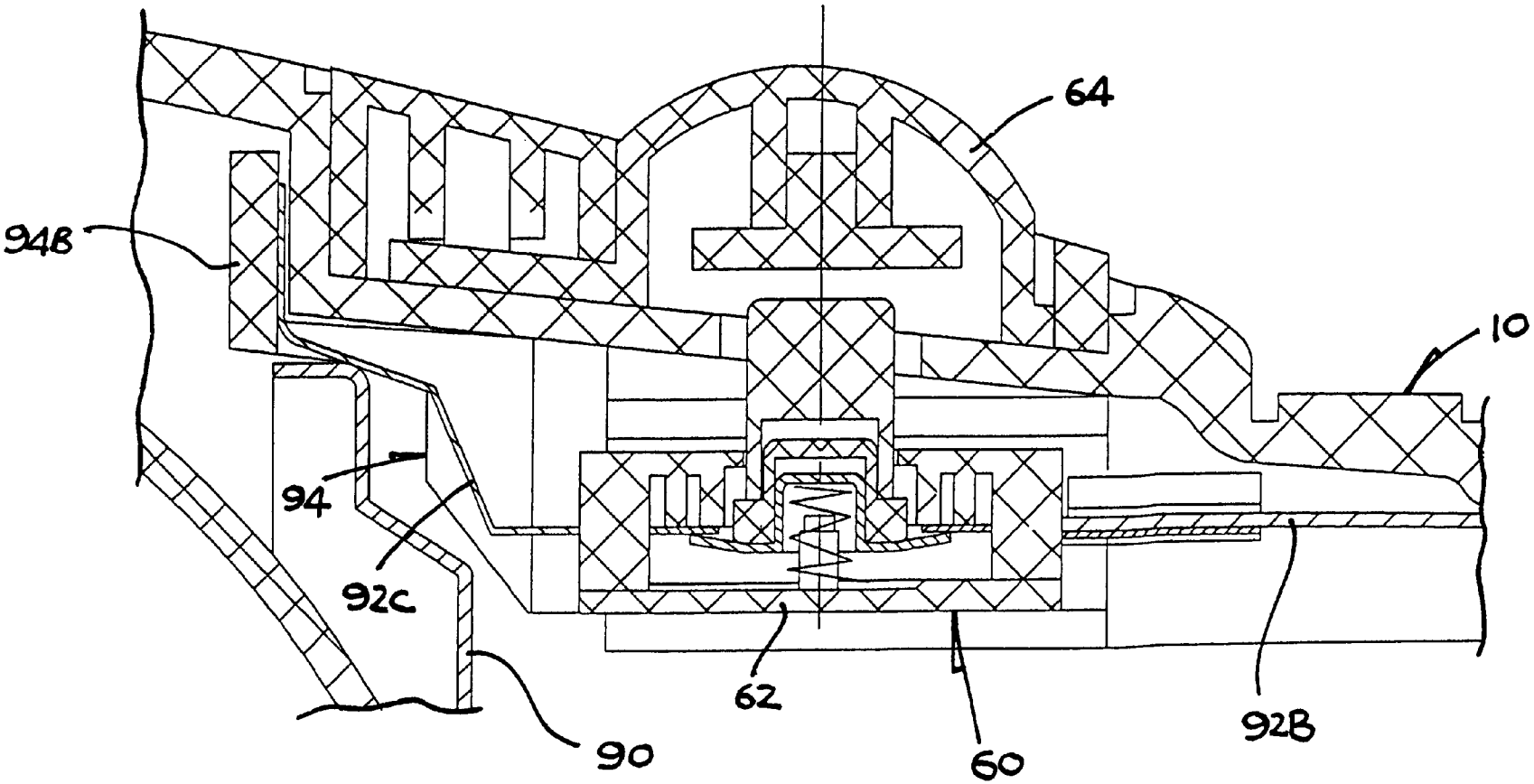
FIG. 3 is an enlarged cross-sectional side view of part of the lighting device of FIG. 1, showing an on/off switch and its connection.

Referring to the drawings, there is shown a lighting device embodying the invention, which device is in the form of a torch or flashlight 100 having a plastic body including a barrel 10 and a head 20. The barrel 10 has a closed rear end 12 and an open end at which the head 20 is integrally located. The head 20 has an open front end 22 and an open rear end integral with the barrel 10. The barrel 10 defines a compartment 14 for containing two battery cells 16.

The flashlight 100 includes a screw-on head cap 30 incorporating a glass plate 32 closing the head's front end 22 and a tail cap 40 attached to the barrel's rear end 12 and providing a carrying loop 42. Clamped between the glass plate 32 and the head's front end 22 is a co-axial cup reflector 34 extending backwards into the head 20. The reflector 34 has a small open rear end 36 provided externally and co-axially with a fixed screw-threaded collar 38, through which a light bulb 50 extends co-axially forwards into the reflector 34. A conductive disc 90 is clamped co-axially between the reflector's rear end 36 and a collar 38, which is internally in contact with an annular side terminal 50B of the light bulb 50 for extending the side terminal 50B radially outwards.

The light bulb 50 is fixed by means of a tubular support 52 screwed onto the collar 38 from behind. An on/off switch 60 is located on one side of the head 20 adjacent the support 52. The switch 60 has a plastic base 62 containing a switching mechanism and a rubber press use-activated knob 64 for operation.

The flashlight 100 further includes a pair of front and rear stationary contact units 70 and 80 located at opposite ends of the compartment 14 facing each other, for making contact with the battery cells 16 contained inside the barrel 10.

Each contact unit 70/80 includes a conductive helical coil spring 72/82 having a front end 72A/82A, a conductive end piece in the form of a circular front end cap 74/84 located at the spring front end 72A/82A for contacting the respective adjacent battery cell 16, and a circular holder 76/86 for maintaining substantially straight extension of the spring 72/82 co-axially with the barrel 10 and retaining the end cap 74/84 on the spring front end 72A/82A. The end cap 74/84 encloses the complete spring front end 72A/82A and has a peripheral flange 74A/84A. The holder 76/86 has a central hole 76A/86A, through which the end cap 74/84 is urged outwards by the spring 72/82 from behind. The end cap 74/84 is retained by having its peripheral flange 74A/84A engaged behind the rim defining the hole 76A/86A.

The front holder 76 has a pair of rear-extending hooks 76B on opposite sides and in engagement with the support 52, whereby the overall contact unit 70 is secured co-axially to support 52, with a rear end 72B of the spring 72 inserted into the support 52. A coloured front washer 78 may be provided within the holder 76, as shown, for decoration. Another conductive end cap 75, which is slightly smaller than the front end cap 74, encloses the rear spring end 72B for contact with an end terminal 50A of the light bulb 50.

The rear holder 86 includes, immediately on its rear side, a co-axial disc 86B. The disc 86B has a pair of hooks 86C on opposite sides which engage the holder 86 to hold the spring 82 in compression. The contact unit 80 is electrically connected to the switch 60 by means of a conductive strip 92. The strip 92 extends longitudinally along the inner surface of the barrel 10, and has a rear end 92A clamped between the spring end 82B and the disc 86B and a front end 92B reaching into the switch base 62. A rivet 88 secures the strip end 92A to the disc 86B.

The front end 92B of the strip 92 acts as a first terminal of the switch 60 on one side. The second terminal of the switch 60 is provided by a short conductive strip 92C which has an end connected to the opposite side of the switch base 62 and is located in position by means of a plastic bracket 94. The bracket 94 has a pair of opposed rear ends 94A embracing the switch base 62 and a 90° turned front end 94B covering and thus protecting the free end of the strip 92C. The intermediate portion of the strip 92C is exposed for contact by the conductive disc 90 and, in turn, connection to the side terminal 50B of the light bulb 50. The strip 92C may be taken as a separated extension from the front end 92B of the longer strip 92, with the switch 60 connected in the gap between the strips 92 and 92C.

Inside the compartment 14, the battery cells 16 are pressed between the contact units 70 and 80. The contact units 70 and 80, the conductive disc 90 and the conductive strips 92 and 92C together complete the electrical circuit between the light bulb 50 and the battery cells 16 via the switch 60.

Each end cap 74/84 covers the respective spring end 72A/82A, hiding, in particular, the loose end of the helical wire forming the spring 72/82, to provide a smooth, sturdy and reliable contact for, and for protecting, the adjacent battery cell 16. Equally as important, each holder 76/86 maintains the respective spring 72/82 substantially straight, thereby preventing any tilting of the spring 72/82 and damage as well as ensuring proper contact with and protection for the adjacent battery cell 16. The bracket 94 also protects the strip 92C.

It is envisaged that the end piece 74/84 may take any other suitable form to cover the respective spring end 72A/82A, such as a plug or a disc having a stem engaged co-axially with the respective spring end 72A/82A.

The invention has been described by way of example only, and various other modifications of and/or alterations to the described embodiment may be made by persons skilled in the art without departing from the scope of the invention as specified in the appended claims.

What is claimed is:

1. A lighting device comprising:

a body having a compartment for containing a battery cell, a light source supported by the body for energization by the battery cell, a switch on the body for controlling energization of the light source, and first and second contact units located at opposite ends of the compartment for making co-axial contact with opposite ends of the battery cell, the first contact unit comprising a co-axial conductive first coil spring having a front end and a rear end, a cylindrical conductive first end piece having a recess receiving and retaining the front end of the first coil spring and contacting the battery cell and a peripheral flange surrounding the recess, a first stationary holder having a hole receiving and retaining the first end piece and engaging the peripheral flange of the first end piece, a cylindrical conductive second end piece having a recess receiving the rear end of the first coil spring and contacting the light source, and a support receiving and retaining the second end piece.

2. The lighting device as claimed in claim 1, wherein the first coil spring is a helical coil spring.

3. The lighting device as claimed in claim 1, including a bracket and a conductive strip located between the light source and the switch, the conductive strip being positioned by the bracket, the bracket covering a free end of the strip.

4. The lighting device as claimed in claim 3, wherein a second end of the strip is connected to the switch and the strip has an intermediate portion exposed for connection to the light source.

5. The lighting device as claimed in claim 1, wherein the second contact unit comprises a coaxial conductive second coil spring having a front end and a rear end, a cylindrical conductive third end piece having a recess receiving and retaining the front end of the second spring for contacting the battery cell and a peripheral flange surrounding the recess, and a second stationary holder having a hole receiving and retaining the third end piece and engaging the peripheral flange of the third end piece.

6. The lighting device as claimed in claim 5, wherein the second contact unit includes a rear holder including a pair projecting hooks inserted inside the second spring at the rear end of the second spring.

* * * * *